US005240590A

United States Patent [19]

Brar et al.

[11] Patent Number: 5,240,590

[45] Date of Patent: Aug. 31, 1993

[54] PROCESS FOR FORMING A BEARING SURFACE FOR ALUMINUM ALLOY

[75] Inventors: Amarjit S. Brar, Edina; Anthony C. Dierich, Maplewood; Prativadi B. Narayan, Eden Prairie, all of Minn.

[73] Assignee: Seagate Technology, Inc., Scotts Valley, Calif.

[21] Appl. No.: 922,357

[22] Filed: Jul. 29, 1992

Related U.S. Application Data

[63] Continuation of Ser. No. 382,104, Jul. 19, 1989, abandoned.

[51] Int. Cl.[5] ..... C25D 11/16; C25D 11/24

[52] U.S. Cl. ..... 205/208; 205/213; 205/222; 205/229

[58] Field of Search ..... 205/208, 213, 222, 229

[56] References Cited

U.S. PATENT DOCUMENTS

| | | | |
|---|---|---|---|
| 3,505,179 | 4/1970 | Mader | 204/33 |
| 4,288,299 | 9/1991 | Carter | 204/376 |
| 4,444,628 | 4/1984 | Furukawa et al. | 204/29 |
| 4,647,346 | 3/1987 | Miller et al. | 204/29 |

OTHER PUBLICATIONS

*Metal Finishing Guidebook and Directory* for 1975, Metals and Plastics Publications, Inc., Hackensack, N.J., pp. 67–75.

H. Silman et al, *Protective and Decorative Coatings for Metals*, Finishing Publications, Ltd., Teddington, Middlesex, England, 1978, pp. 115–122.

*Primary Examiner*—John Niebling
*Assistant Examiner*—William T. Leader
*Attorney, Agent, or Firm*—Kinney & Lange

[57] ABSTRACT

A process for forming a bearing surface on an aluminum alloy article including the steps peening the surface, anodizing the surface, and washing the anodized surface with a boehmite inhibiting agent.

22 Claims, No Drawings

PROCESS FOR FORMING A BEARING SURFACE FOR ALUMINUM ALLOY

This is a continuation of application Ser. No. 07/382,104 filed on Jul. 19, 1989, abandoned as of the date of this application.

BACKGROUND OF THE INVENTION

1. Field of the Invention

The present invention relates to metal finishing and in particular to the provision of a durable, wear resistant finish on aluminum alloy castings which is suitable as a bearing surface.

2. Description of the Prior Art

Aluminum and aluminum alloys are popular materials for fabrication of light weight articles. The fabrication of such articles can involve machining from wrought aluminum or casting from aluminum alloy. Casting is considerably less expensive than machining. However, casting is generally unsuccessful when attempted with pure aluminum. Instead, specially formulated aluminum alloys are employed which allow the molten material to flow during the casting process. These specially formulated alloys often contain substantial concentrations of silicon.

For wear resistant articles, aluminum is most commonly finished by anodizing, an electro-chemical process in which electrolytically generated oxygen chemically combines with surface aluminum to form a hard, durable aluminum oxide surface layer. Unfortunately, the silicon containing alloys most suitable for casting do not form acceptable anodized finishes. The silicon component of the alloys interferes with or interrupts the formation of a continuous and strongly adhering aluminum oxide layer on the surface of the casting material. The resulting anodized coating is insufficient to provide a hard, durable, wear resistant surface.

Aluminum castings including a durable, hard bearing surface with a reduced tendency to generate particulates under bearing use and wear conditions would be particularly useful in close tolerance, high precision mechanical environments which must remain substantially dust free. Disk drive systems are an example of such an environment. Particulate contamination within a disk drive tends to cause the flying head to crash into the rapidly spinning disk, thereby damaging or destroying both magnetically stored data and the disk drive itself.

Presently, aluminum based castings requiring hard, durable bearing surfaces, are produced by the addition of a separate piece of non-cast, pure aluminum to the casting. Subsequent to the addition, the article is anodized. Thus, the economic advantage of casting, (specifically, the avoidance of expensive machining operations) is lost with the addition of the pure aluminum.

The problem of providing a casting with an anodized finish which allows a uniformly dyed appearance is addressed by Furukawa in U.S. Pat. No. 4,444,628. The disclosed process comprises the steps of chemically polishing a casting, barrelling and/or blasting the chemically polished casting to mechanically treat the surface and remove irregularities, followed by degreasing, anodizing, dyeing and sealing.

SUMMARY OF THE INVENTION

The present invention includes a process for producing a hard, durable surface finish upon an aluminum alloy casting. The resulting surface is a suitable bearing surface. The process includes the steps of peening (mechanically densifying) the surface to be processed; dissolving silicon from the surface of the casting to provide a surface layer of enriched aluminum; anodizing the enriched aluminum surface; washing the anodized surface with a beohmite inhibiting agent; mechanically polishing the washed surface to a desired shape; and washing the mechanically polished surface with a beohmite inhibiting agent. The present invention also includes a casting with a bearing surface produced by the above process.

DETAILED DESCRIPTION OF THE PREFERRED EMBODIMENT

The present invention provides a hard durable surface finish upon an aluminum alloy casting. The surface is suitable for use as a bearing surface. A process in accordance with the present invention includes the steps of peening (mechanically densifying) the surface of the casting; dissolving silicon from the surface of the casting to provide a surface layer of enriched aluminum; anodizing the enriched aluminum surface; washing the anodized surface with a beohmite inhibiting agent; mechanically polishing the washed surface to a desired shape; and washing the mechanically polished surface with a beohmite inhibiting agent. The present invention also includes a casting with a bearing surface produced by the above process. The process steps are described immediately below. Subsequently, an article prepared by the process is described.

PEENING (MECHANICALLY DENSIFYING) THE SURFACE DESIRED AS THE BEARING SURFACE

An aluminum alloy casting is provided for the process. Preferably, the casting is an investment-type casting of type 356-T6 aluminum alloy although the process of this invention is generally applicable to articles of various aluminum alloys. The surface where the bearing surface is desired is polished to approximate the shape and dimensions of the finished bearing surface. Optionally, the surface can also be machined before polishing. Techniques for casting, machining and polishing are standard processes which are well known within the art.

Castings, machined castings and polished castings of aluminum alloy tend to have somewhat porous surfaces. In the step to be described, the porosity of the surface is reduced and the density of the casting at the surface increased by mechanical treatment. A preferred mechanical treatment is shot peening which is accomplished by hitting the surface with steel balls. The steel balls may be propelled by air or gravity or other known propelling means. The steel balls are directed to repeatedly strike the particular surface of the casting which is desired to become a bearing surface. Alternatively, peening by "blasting" with smaller particles may be employed and is generally accomplished by contacting the surface to be treated with hard or abrasive type particles propelled by a blast of a compressed gas, typically air. The stream may optionally include water. Examples of metallic abrasives include cast iron shots, steel shots, and steel grits. Examples of non-metallic particles include silica, carborundum, and glass beads.

Alternatively, substantially the entire surface may be mechanically treated by "barreling" (tumbling in a barrel) the aluminum alloy casting with a media such as metal balls, plastic particles, silica particles, or synthetic emery particles. Optionally, compounds such as soap, glycerin, or other surfactants, may be included in a rotating-type barrel, vibration-type barrel, or gyration-type barrel. A vibration-type barrel with steel balls as a medium has economic advantages when substantially the entire surface of the casting is to be mechanically treated.

Generally, to achieve the mechanical treatment of this step, the harder and denser materials are most effective in increasing the density and reducing the porosity of the surface of the casting.

Additionally, while not wishing to be bound by theory, it is believed that the above described mechanical surface treatment increases the hardness of the surface of the casting and ultimately results in a harder bearing surface in the finished product. Further, it is also believed that the mechanical treatment of the surface of the casting introduces beneficial compressive stresses at and immediately adjacent to the surface. These compressive stresses result in a better bearing surface, since they serve to partially "self-heal" or allow some "recovery" from fissures and cracks generated during subsequent use and wear of the finished surface as a bearing surface. Also, it is believed the anodizing of the surface of a more porous, non-mechanically treated casting results in a less uniform and more brittle anodized layer. Such brittle surface layers tend to generate undesirable particulate matter under bearing wear conditions and, therefore, are undesirable for use in high precision mechanical equipment which must remain substantially dust free, such as disk-drives.

DISSOLVING SILICON FROM THE SURFACE OF THE CASTING TO PROVIDE A SURFACE LAYER OF ENRICHED ALUMINUM

Castings of aluminum alloys contain a significant silicon content and/or other non-aluminum materials. Selective removal of silicon from the surface results in a surface which is enriched in aluminum and more chemically homogeneous or uniform on a microscopic level. For example, type 356 aluminum alloy includes about 7% silicon by weight. An oxide layer can be made more uniform and more tightly adhering by selective removal or dissolution of surface silicon prior to anodizing. The resulting uniform and highly adherent anodized layer has a reduced tendency to generate particles under wear conditions. As previously mentioned, a reduced tendency to generate particulates is highly desirable in a high precision mechanical environment which must remain substantially dust free, such as a disk-drive.

Generally, any agent for selective dissolution of silicon will have a greater capacity to dissolve silicon (and optionally other alloy constituent materials) than a capacity to dissolve aluminum. Exposure of the alloy casting to the selective dissolution agent serves to enrich the surface aluminum content. Silicon can be selectively removed or dissolved from the surface by exposure to a solution including hydrofluoric acid or other fluoride ions. Particularly preferred, is a solution consisting essentially of about 10% hydrofluoric acid, about 30% nitric acid and the balance deionized water. Alternatively, other solutions having the capacity to dissolve both silicon and aluminum may be employed by saturating or nearly saturating the solution with aluminum prior to use as a selective dissolution agent.

ANODIZING THE ENRICHED ALUMINUM SURFACE

The low porosity, enriched aluminum surface is electrochemically converted to a ceramic material by anodization. Specifically, a dense, hard, tough, adherent aluminum oxide surface layer is formed by anodizing. Preferably, this layer is about 2.5 mils thick. Because the level of contaminants resulting from alloy materials other than aluminum is very low, the oxide layer tends to appear white or off-white.

WASHING THE ANODIZED SURFACE WITH A BEOHMITE INHIBITING AGENT

The anodized layer, primarily alumina, when subsequently immersed in water, has a strong tendency to become hydrated. The resulting hydrated material, called pseudo-boehmite for simplicity in this application, may include a mixture of alumina, (anhydrous aluminum oxide), boehmite (aluminum oxide monohydrate), gibbsite and/or bayerite (both of which are aluminum oxide trihydrates). Pseudo-boehmite is soft and undesirable as a bearing surface because it is subject to rapid wear and particle generation. It has been surprisingly discovered that formation of pseudo-boemite material is inhibited or prevented by washing any residual anodizing bath from the anodized casting with an aqueous solution of about 10% orthophosphoric acid.

MECHANICALLY POLISHING THE WASHED SURFACE TO A DESIRED SHAPE

The washed bearing surface is shaped, (for example: smoothened and flattened), by mechanical polishing. Preferably, the shaping is achieved by lapping with diamond grit.

The outermost portion of the anodized layer, as formed, is somewhat porous and brittle and therefore is a potential source of particulate microcontamination. Removal, by polishing, of roughly about the outermost 20 to 30% of the layer eliminates much of the potential for generating particulate microcontamination. Preferably about 25% of the layer is removed by polishing.

The material to be shaped may be described as a ceramic surface layer upon an aluminum alloy casting. If the shaping process is accomplished by a lapping process which employs progressively finer grit size at each stage of lapping, residual stresses associated with the oxide layer can be relieved or reduced while the surface is shaped. Preferably, lapping is performed by sequential use of approximately one micron diamond grit, followed by approximately 0.5 micron diamond grit, and finishing with approximately 0.1 micron diamond grit. By reducing the residual stresses in the oxide bearing surface, the surface becomes less brittle and therefore has a reduced tendency to generate particulates under bearing wear conditions. On a 2.5 mil thick oxide layer formed upon a machined flat area of a 356-T6 aluminum alloy investment casting, the progressive polishing step was employed to lap the bearing surface to about a 2 mil thick layer with about 1 microinch surface roughness.

WASHING THE MECHANICALLY POLISHED SURFACE WITH A BEOHMITE INHIBITING AGENT

Preferably, the bearing surface is washed after shaping or lapping with a pseudo-boehmite preventing or inhibiting agent. As previously described, when the anodized layer, (primarily formed of alumina), is subsequently immersed in water it has a strong tendency to become hydrated. The resulting material, described as pseudo-boehmite, is soft and subject to wear and particulate generation under wear conditions and thus is undesirable in a bearing surface. Formation of pseudo-boehmite material is inhibited or prevented by washing the shaped or lapped bearing surface with an aqueous solution of about 10% orthophosphoric acid.

EXAMPLE 1

A one piece bearing rail including bearing surfaces was prepared by the process of the invention. Specifically, an investment casting of 356-T6 aluminum alloy was provided. The areas which were to serve as bearing surfaces were machined and polished to provide generally flat areas about 5 mm wide and about 10 cm in length. The polished surfaces were shot-peened. Next, the peened surfaces where chemically polished by immersion for in a solution of 10% hydrofluoric acid, 30% nitric acid and the balance deionized water. Next the casting was anodized by the Sanford-Quantum process. The depth of the resulting oxide layer was about 2.5 mils thick. The anodized casting was washed with a 10% orthophosphoric acid solution. After washing, the bearing surface was lapped with 1 micron diamond grit, followed by 0.5 micron diamond grit, followed by 0.1 micron diamond grit. After lapping, the bearing surface was again washed with 10% orthophosphoric acid. The final bearing surface was about 2 mils thick and 1 microinch in roughness.

A disk drive was assembled using this part and found to be highly durable.

Although the present invention has been described with references to preferred embodiments, workers skilled in the art will recognize that changes may be made in form and detail without departing from the spirit and scope of the invention.

What is claimed is:

1. A process for producing a uniform, highly adherent anodized aluminum layer on a surface of a cast aluminum alloy article, comprising the steps:

peening a surface of the article to create a peened surface with increased density of non-aluminum constituents at the peened surface;

selectively etching the peened surface of the article to remove non-aluminum constituents from the peened surface to create an etched surface so that aluminum concentration at the etched surface is higher than in an interior region of the article;

anodizing the etched surface to produce an anodized layer;

polishing the surface to remove an outermost 20 to 30% of the anodized layer; and washing the surface with a pseudo-boehmite inhibiting agent.

2. The process of claim 1 wherein the etching step includes exposure to an HF or fluoride ion containing solution.

3. The process of claim 2 wherein the solution comprises about 10% HF and about 30% $HNO_3$.

4. The process of claim 1 wherein the peening of the surface is applied only to a selected portion of the surface.

5. The process of claim 1 wherein the article is cast from type 356 aluminum alloy.

6. A process for producing a uniform, highly adherent anodized aluminum layer on a surface of an aluminum alloy article, comprising the steps:

peening a surface of the article to produce a peened surface;

selectively etching the peened surface of the article to remove elements other than aluminum to produce an etched surface so that aluminum concentration at the etched surface is higher than in an interior region;

anodizing the etched surface to form an anodized layer;

washing the anodized layer with a boehmite inhibiting agent;

polishing the anodized layer, such that the polishing step removes an outermost portion of the anodized layer to form a polished anodized layer; and washing the polished anodized layer with a boehmite inhibiting agent.

7. The process of claim 6 wherein the peening of the surface is applied only to a selected portion of the surface.

8. The process of claim 6, wherein the etching step includes exposing the peened surface to a solution comprising about 10% HF and about 30% $HNO_3$.

9. The process of claim 6, wherein the boehmite inhibiting agent is $H_3PO_4$.

10. The process of claim 6 wherein the article is cast from type 356 aluminum alloy.

11. A process for producing a uniform, highly adherent anodized aluminum layer on a surface of an aluminum alloy article, comprising the steps:

peening a selected portion of a surface to create a peened surface with increased density of non-aluminum constituents at the peened surface;

selectively etching the peened surface of the article to remove elements other than aluminum to produce an etched surface so that aluminum concentration at the etched surface is higher than in an interior region;

anodizing the etched surface to produce an anodized layer;

polishing the anodized layer, such that the polishing step removes an outermost portion of the anodized layer to form a polished anodized layer; and washing the polished anodized layer with a boehmite inhibiting agent.

12. The process of claim 11, wherein the etching step includes exposing the peened surface to a solution comprising about 10% HF and about 30% $HNO_3$.

13. The process of claim 11, wherein the boehmite inhibiting agent is $H_3PO_4$.

14. The process of claim 11 wherein the article is cast from type 356 aluminum alloy.

15. A process for producing a uniform, highly adherent anodized aluminum layer on a surface of an aluminum alloy article, comprising the steps:

peening a surface of the article to produce a peened surface;

selectively etching the peened surface of the article by exposing the peened surface to an HF or fluoride ion containing solution;

anodizing the etched surface to produce an anodized layer;

polishing the anodized layer, such that the polishing step removes an outermost portion of the anodized layer to produce a polished anodized layer; and washing the polished anodized layer with a boehmite inhibiting agent.

16. The process of claim 15 wherein the peening of the surface is applied only to a selected portion of the surface.

17. The process of claim 15, wherein the boehmite inhibiting agent is $H_3PO_4$.

18. The process of claim 15 wherein the article is cast from type 356 aluminum alloy.

19. The process of claim 15 wherein the solution comprises about 10% HF and about 30% $HNO_3$.

20. A process for producing a uniform, highly adherent anodized aluminum layer on a surface of an aluminum alloy article, comprising the steps:

peening a surface of the article to produce a peened surface;

selectively etching the peened surface of the article to remove elements other than aluminum to produce an etched surface so that aluminum concentration at the etched surface is higher than in an interior region;

anodizing the etched surface to form an anodized layer;

washing the anodized layer with an $H_3PO_4$ solution;

polishing the anodized layer, such that the polishing step removes an outermost portion of the anodized layer to produce a polished anodized layer; and washing the polished anodized layer with an $H_3PO_4$ solution.

21. The process of claim 20 wherein the peening of the surface is applied only to a selected portion of the surface.

22. The process of claim 20 wherein the article is cast from type 356 aluminum alloy.

* * * * *